United States Patent [19]

Walters et al.

[11] 4,021,736

[45] May 3, 1977

[54] CIRCUIT FOR MEASURING THE REFRACTORY PERIOD OF A HEART PACER

[75] Inventors: Robert A. Walters, Pittsburgh; Russell E. Hirtz, Springdale, both of Pa.

[73] Assignee: ARCO Medical Products Company, Leechburg, Pa.

[22] Filed: Mar. 15, 1976

[21] Appl. No.: 666,740

[52] U.S. Cl. ..... 324/181; 128/2.06 F; 128/2.05 T

[51] Int. Cl.[2] ..... G04F 8/00

[58] Field of Search ..... 324/181, 186, 187, 78 Z; 128/2.05 R, 2.05 P, 2.06 R, 2.06 A, 2.06 F, 2.05 T

[56] References Cited

UNITED STATES PATENTS

| | | | |
|---|---|---|---|
| 3,773,038 | 11/1973 | Smith | 128/2.05 T |
| 3,857,398 | 12/1974 | Rubin | 128/2.06 F |
| 3,858,574 | 1/1975 | Page | 128/2.05 T |

*Primary Examiner*—Rudolph V. Rolinec
*Assistant Examiner*—Michael J. Tokar
*Attorney, Agent, or Firm*—Richard A. Bachand

[57] ABSTRACT

A circuit for measuring the refractory period of a heart pacer includes first, second and third monostable multivibrators. The first monostable multivibrator is reset by the reception of a pacer stimulation pulse to produce a state change for a time period longer than the stimulation pulse interval of the pacer. The second monostable multivibrator is triggered by the trailing edge of the stimulation pulse, and has a variable time constant to produce a state change for a controlled period of time. The third monostable multivibrator applies a pulse to the pacer at the conclusion of the state change of the second monostable multivibrator. A counter is provided which counts the stimulation pulses produced by the pacer, and is connected to a resistive time constant circuit, to add additional time controlling resistors into the time constant circuit of the second monostable multivibrator. A latch circuit discontinues the advancement of the counter after the first monostable multivibrator state change is reached, and a pulse width monitor indicates the time width of the state change of the second monostable multivibrator to thereby indicate the refractory period of the pacer.

2 Claims, 2 Drawing Figures

10
JKFF
MSMV
COUNTER
IND.
390K
200K
100K
51K
27K
13K
6.2K
470K

CIRCUIT FOR MEASURING THE REFRACTORY PERIOD OF A HEART PACER

BACKGROUND OF THE INVENTION

1. Field of the Invention

This invention relates to circuits for measuring heart pacer parameters, and, more particularly, to a circuit for measuring the refractory period of a heart pacer.

2. Description of the Prior Art

Although in the past heart pacers have been proposed which present variable refractory periods, in so far as is known to applicant, no circuits have been proposed which measure the refractory period of a heart pacer.

More particularly, the refractory period of a heart pacer is generally known as the time period after the delivery of a stimulation pulse to the patient's heart or after the production of a naturally produced heart wave during which the heart pacer is insensitive to electrical signals which may be received by it. Thus, for example, in the case of a demand heart pacer, if a signal having the characteristics of a naturally produced R-wave is received within the refractory period of a heart pacer, the heart pacer will, nevertheless, deliver a stimulation pulse at the predetermined timed period after the last stimulation pulse or after the last naturally produced heart pulse. On the other hand, if such signal is received at a time period beyond the refractory period of the pacer, the pacer will be reset to reinitiate its timing of the next to be delivered stimulation pulse from the reception of the electrical pulse.

What is needed, therefore, is a means for accurately measuring the refractory period of a heart pacer under consideration to determine whether the refractory period presented thereby is of proper length.

SUMMARY OF THE INVENTION

In light of the above, therefore, it is an object of the invention to provide a circuit for measuring the refractory period of a heart pacer.

It is another object of the invention to provide a circuit which produces a pulse of width equal to the refractory period of a demand heart pacer.

It is another object of the invention to provide a digital circuit for measuring the refractory period of a demand heart pacer.

These and other objects, features, and advantages will become apparent to those skilled in the art from the following detailed description when read in conjunction with the accompanying drawing and appended claims.

In accordance with a broad aspect of the invention, a circuit is presented for measuring the refractory period of a heart pacer, and is adapted to be connected to an input/output terminal thereof. The circuit includes means for connection to the input/output terminal for developing a pulse for application to the terminal, the developed pulse being increased step-wise after the conclusion of each pacer stimulation pulse. Means are provided for applying a pulse to the input/output terminal of the pacer upon the conclusion of the developed pulse, and means for discontinuing the step-wise increase of said developed pulse are provided operable when said pacer is inhibited from developing stimulation pulses by the applied pulse. Thus, the width of the developed pulse immediately preceding the inhibiting of the pacer corresponds to the refractory period of the pacer and can be directly measured.

BRIEF DESCRIPTION OF THE DRAWING

The invention as illustrated in the accompanying drawing wherein.

DETAILED DESCRIPTION OF THE PREFERRED EMBODIMENTS

Figure 1:
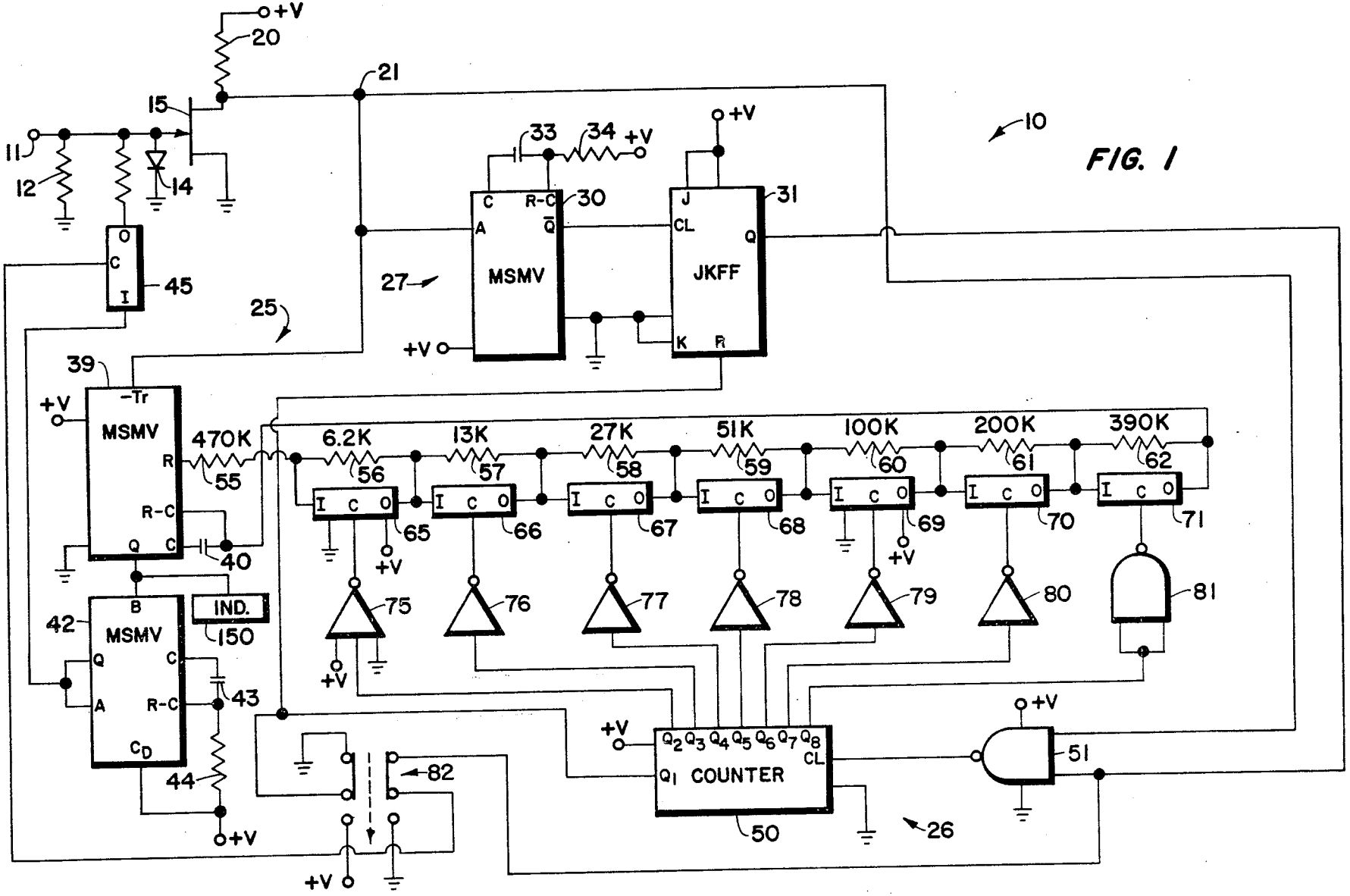
FIG. 1 is a schematic diagram of the refractory period measuring circuit of the invention.

As shown in FIG. 1, a circuit 10 is provided for measuring the refractory period of a heart pacer (not shown). The electrodes of the heart pacer under test which receive naturally occurring heart pulses and upon which stimulation pulses are delivered to the heart are connected to an input terminal 11 and ground (the ground connection not shown) to develop an input voltage across an input resistor 12 connected to ground. A diode 14 is connected in parallel with the resistor 12 to limit the maximum voltage applied to a MOSFET 15. The terminal 11 is connected to the gate of the MOSFET 15. The drain of the MOSFET 15 is connected to ground, and the source is connected by a resistor 20 to a positive voltage. The MOSFET 15 serves to change a negative going pacer pulse to a positive pulse upon the line 21, for application to the various circuit elements, as below described. The output of the MOSFET 15 is conducted to three main circuits, a delay measuring circuit 25, a timing circit 26 and a circuit stop control 27.

The circuit stop control 27 serves to enable the remainder of the circuitry of the refractory analyzer 10 to operate. It includes a monostable multivibrator 30 and a J-K flip-flop 31. The monostable multivibrator 30 is triggered upon its A terminal to present an output state upon its Q terminal for a time determined by the time constant of a capacitor 33 and resistor 34. In the embodiment illustrated, the monostable multivibrator 30 is configured to produce a low state upon the Q terminal for approximately 900 milliseconds after a pulse is applied to the A terminal. This time period is in excess of the pacer stimulation pulse interval, which is ordinarily on the order of about 833 milliseconds.

The J-K flip-flop 31 is arranged to latch upon the transition from low to high states upon the output of the Q terminal of the monostable multivibrator 30.

As mentioned, the output from the MOSFET 15 is connected to the delay generating circuit 25. In the embodiment illustrated, a monostable multivibrator 39 is provided which is triggered upon a change in state from high to low states (the trailing edge of the input pulse) to produce an output upon the Q terminal thereof for a time controlled by the time constant of the capacitor 40 and the resistors of the timing circuit 26 below described in detail.

The output from the monostable multivibrator controls a monostable or "one shot" multivibrator pulse generator 42 upon a change in state from high to low. The time constant of the capacitor 43 and resistor 44 controls the width of the pulse produced by the "one shot" multivibrator 42 to approximately 45 milliseconds. The output from the "one shot" multivibrator 42 upon the Q terminal thereof is delivered via a bilateral switch 45 to the pacer connected terminal 11 for delivery of the pulse generated by the "one shot" multivibrator 42.

As mentioned above, the time constant of the monostable multivibrator 39 is controlled by the values of the various resistors of the counter circuit 26, and their selection is controlled as follows. The output of the MOSFET 15 is connected to the clock input of a counter 50 via a NAND gate 51. Additionally, the output of the J-K flip-flop 31 is connected to an input of the NAND gate 51 to enable the MOSFET output pulses to pass therethrough until the latch circuitry has been activated at the uninterrupted termination of a 900 millisecond interval counter by the monostable multivibrator 30.

Eight resistors 55–62 are connected in series between the R terminal and the R-C common terminal of the monostable multivibrator 39. Each of the respective bilateral switches 65–71 are connected in parallel with a respective resistor 56–62. The bilateral switches 65–71 are controlled by respective outputs of the counter 50 inverted by respective inverters 75–81. Thus, the counter 50 is advanced one binary count for each pacer pulse developed at the output of the MOSFET 15 to control the respective bilateral switches 55–71, thereby connecting selected ones of the resistors 56–62 in series with the resistor 55 to control the time constant of the monostable multivibrator 39. It can be seen that as the count of the counter 50 is progressively increased, the value of the resistor establishing the R-C time constant of the monostable multivibrator 39 can be controllably increased. For example, in the embodiment illustrated, the time constant of the monostable multivibrator is initially about 208 milliseconds. Upon the first count by the counter 50, the bilateral switch 65 is closed connecting the resistor 56 in series with the resistor 55 to produce a time constant of about 210 milliseconds. Upon the next detected pulse by the counter 50, the bilateral switch 65 is opened and the bilateral switch 66 is closed, to thereby produce a time constant controlled by the values of the resistors 55 and 57 to about 213 milliseconds. Next, upon the next subsequent pulse by the counter 50, both bilateral switches 65 and 66 are closed to connect the resistors 55, 56 and 57 in series to produce a time constant of about 215 milliseconds, and so forth.

Figure 2:
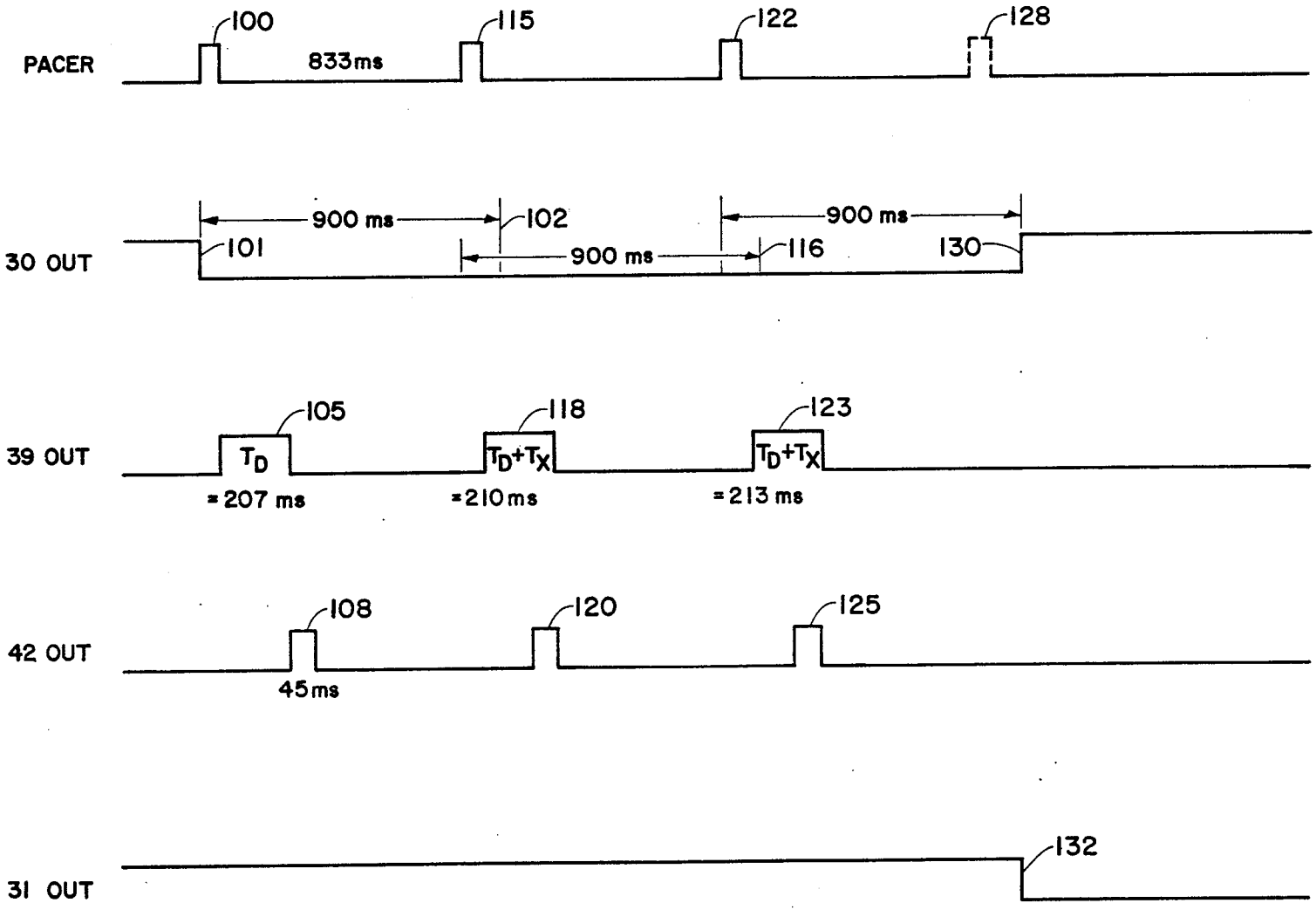
FIG. 2 is a series of waveforms at various points in the circuit of FIG. 1 to illustrate the operation of the circuit.

In operation, the circuit is first manually reset to an initial state by activation of a reset switch 82. The operation of the refractory circuit 10 is now described with reference to the waveforms shown in FIG. 2. Upon the reception of a pacer pulse 100 developed upon the load resistor 20 of the MOSFET 15, the monostable multivibrator 30 changes in state from high to low, the transition being denoted by the reference numeral 101 upon the graph labeled "30 out". The low state is continued for 900 milliseconds absent retriggering of the monostable multivibrator, the termination of the 900 millisecond period being indicated by the vertical line 102.

When the trailing edge of the pulse developed by the MOSFET 15 appears, the monostable multivibrator 39 is triggered to produce an output state change from low to high, developing a pulse 105 (see graph "39 out") initially of width determined by the time constant of the resistor 55 and capacitor 40 (each of the bilateral switches 65–71 being closed). In the embodiment illustrated, the delay pulse produced by the time constant of the resistor 55 and capacitor 40 with the particular monostable multivibrator circuit used is about 207 milliseconds.

Upon the completion of the pulse 105 produced by the monostable multivibrator 39, the "one shot" multivibrator 42 is activated to produce a 45 millisecond pulse 108 (see graph "42 out"). The pulse 108 is delivered via the bilateral switch 45 to the pacer connected terminal 11. If the width of the pulse 105 produced by the monostable multivibrator 39 is less than the refractory period of the pacer, the pulse 108 produced by the "one shot" multivibrator 42 will fall within the refractory period of the pacer, and will have no resetting effect. Thus, the pacer will be enabled to produce a subsequent stimulation pulse 115 as shown in the upper graph labeled "pacer."

The pacer pulse 100, in addition to triggering the monostable multivibrators 30 and 39, is additionally applied via the NAND gate 51 to advance the counter 50. Thus, the time constant of the monostable multivibrator 39 is lengthened by the addition of the resistor 56 to its time constant.

Since the pacer pulse 115 occurred at a time prior to the termination of the initial 900 millisecond time period of the monostable multivibrator 30, the monostable multivibrator 30 is retriggered to reinitiate a subsequent 900 millisecond period ending at the line shown on the graph "30 out".

When the trailing edge of the pulse 115 is applied to the monostable multivibrator 39, the monostable multivibrator 39 is triggered to produce an output pulse 118 of width equal to the time constant established by the resistors 55 and 56 and the capacitor 40. In the embodiment illustrated, this time is approximately 210 milliseconds. Upon the termination of the pulse 118, a 45 millisecond pulse 120 is applied to the pacer. Again, if the pulse 120 falls within the refractory period of the pacer, it will not be reset, thereafter producing a stimulation pulse 122.

This process of adding selected ones of the resistors 56–62 to the resistor 55 is continued until the pulse delivered by the "one shot" multivibrator 42 falls outside of the refractory period, and inhibits the generation of a stimulation pulse. Thus, for example, in the graph of FIG. 2, the pacer stimulation pulse 122 reinitiates a 900 millisecond time period. The trailing edge initiates the generation of a pulse 123, the width of which is established by the time constant of the resistors 55 and 57 and the capacitor 40 to be approximately 213 milliseconds. Upon the completion of the pulse 123, the "one shot" multivibrator 42 produces a 45 millisecond pulse 125. It is assumed that the pulse 125 now falls outside of the refractory period of the pacer, and therefore inhibits the generation of a stimulation pulse which would occur at the time indicated by the dotted pulse 128. Thus, the monostable multivibrator 30 is not retriggered, and changes state from low to high at point 130 at the conclusion of its 900 millisecond time period. The change in state from low to high of the monostable multivibrator 30 triggers the output of the dual J-K flip-flop latch 31, as shown on the graph "31 out", to change from high to low states at point 132. This change in state is applied to the NAND gate 51 which precludes further passage of the counter advancing pacer pulses developed by the MOSFET 15. In addition, the change in state disables the bilateral switch 45 to prevent further passage of the 45 millisecond pulses developed by the "one shot" multivibrator 42.

Since the pulses 105, 118, 123, etc., developed at the output of the monostable multivibrator 39 are step-wise increased by known amounts, the width of the pulse which immediately precedes the inhibiting of the pacer will substantially correspond to the refractory period of the pacer. Thus, a pulse width counter 150 can be connected to the output line upon the terminal Q from the monostable multivibrator 39 to present a direct reading of the pulse width developed thereat, which can be monitored until no further change is detected by virture of the action of the latch circuit 31. This pulse width, then, will correspond to the refractory period of the pacer.

Although the invention has been described and illustrated with a certain degree of particularity, it is understood that the present disclosure has been made only by way of example and numerous changes in details of construction and combination and arrangement of parts may be resorted to without departing from the spirit and the scope of the invention as hereinafter claimed.

We claim:

1. A circuit for measuring the refractory period of a pacer comprising:

means for timing a time period in excess of the normal stimulation rate of the pacer initiated by each pacer produced stimulation pulse;

means triggered by the conclusion of each pacer stimulation pulse for producing a control pulse;

means for enlarging the width of said control pulse in an equal time step upon each sucessive occurrence of said pacer stimulation pulses;

means for applying a pulse of constant width to said pacer at the conclusion of said control pulse;

means for discontinuing the increase in said control pulse width upon the uninterrupted reaching of said time in excess of said stimulation pulse interval;

and means for monitoring the width of said increased pulse to indicate the refractory period of said pacer.

2. A circuit for measuring the refractory period of a heart pacer, adapted to be connected to an input/output terminal thereof, comprising:

first, second and third monostable multivibrators;

said first monostable multivibrator being triggered by a pacer stimulation pulse to change states for a time in excess of the stimulation pulse interval of said pacer;

said second monostable multivibrator being triggered by the conclusion of a pacer stimulation pulse to change states for a controllable period of time;

said third monostable multivibrator producing a pulse to said input/output terminal of said pacer upon the conclusion of the state change of said second monostable multivibrator;

counter means for counting the stimulation pulses produced by said pacer, and time constant means connected tc said counter to controllably vary the time constant of said second monostable multivibrator, increasing step-wise with each subsequent pacer stimulation pulse;

latch means to discontinue the advancement of said counter, said latch means being activated by the reaching of the uninterrupted reaching of the time period of said first monostable multivibrator;

and means for indicating the width of the output pulse of said second monostable multivibrator at the time said latch means is activated.

* * * * *